US005195931A

United States Patent [19]

Wright et al.

[11] Patent Number: 5,195,931

[45] Date of Patent: Mar. 23, 1993

[54] METHOD AND APPARATUS FOR MAKING WIRE NAILS HAVING RADIALLY OFFSET, FULLY CIRCULAR HEADS

[75] Inventors: Robert W. Wright, Buffalo Grove; John Binder, Morton Grove; William L. Gabriel, Barrington, all of Ill.

[73] Assignee: Illinois Tool Works Inc., Glenview, Ill.

[21] Appl. No.: 832,802

[22] Filed: Feb. 7, 1992

[51] Int. Cl.[5] ..... B21G 3/00

[52] U.S. Cl. ..... 470/40; 470/125; 470/121

[58] Field of Search ..... 470/28, 31, 34, 40, 470/121, 122, 125, 137, 141, 146, 156, 157, 159, 160, 132, 134, 136

[56] References Cited

U.S. PATENT DOCUMENTS

| | | | |
|---|---|---|---|
| 248,640 | 10/1881 | Dean | 470/159 |
| 343,839 | 6/1886 | North | 470/133 |
| 521,571 | 6/1894 | O'Neill | 470/34 |
| 1,078,147 | 11/1913 | Johnson | 470/157 |
| 1,103,659 | 7/1914 | Champion | 470/141 |
| 1,187,472 | 6/1916 | Sisson | 470/121 |
| 2,903,720 | 9/1959 | James | 470/40 |
| 4,342,127 | 8/1982 | Weaver | 470/134 |

*Primary Examiner*—Lowell A. Larson
*Assistant Examiner*—Michael J. McKeon
*Attorney, Agent, or Firm*—Schwartz & Weinrieb

[57] ABSTRACT

Nails having radially offset, circular heads are manufactured from a malleable wire. The wire is clamped so that a leading portion extends axially from a clamping mechanism. The extending portion is bent at an acute angle relative to a clamping axis. The extending portion is cut so as to form a pointed end thereon and so as to leave a bent stub extending at such an angle. Such a nail head is formed from the stub, which is pressed by a punch into a cavity defined by the clamping mechanism, and which is deformed when pressed thereinto. The cavity has a fully circular, offset margin. The punch has a face covering the cavity. Once released, the wire is fed axially until a leading portion extends as before. These operations are repeated to form a similar nail in each repetition. A novel apparatus for carrying out these operations is disclosed.

20 Claims, 3 Drawing Sheets

Fig. 1
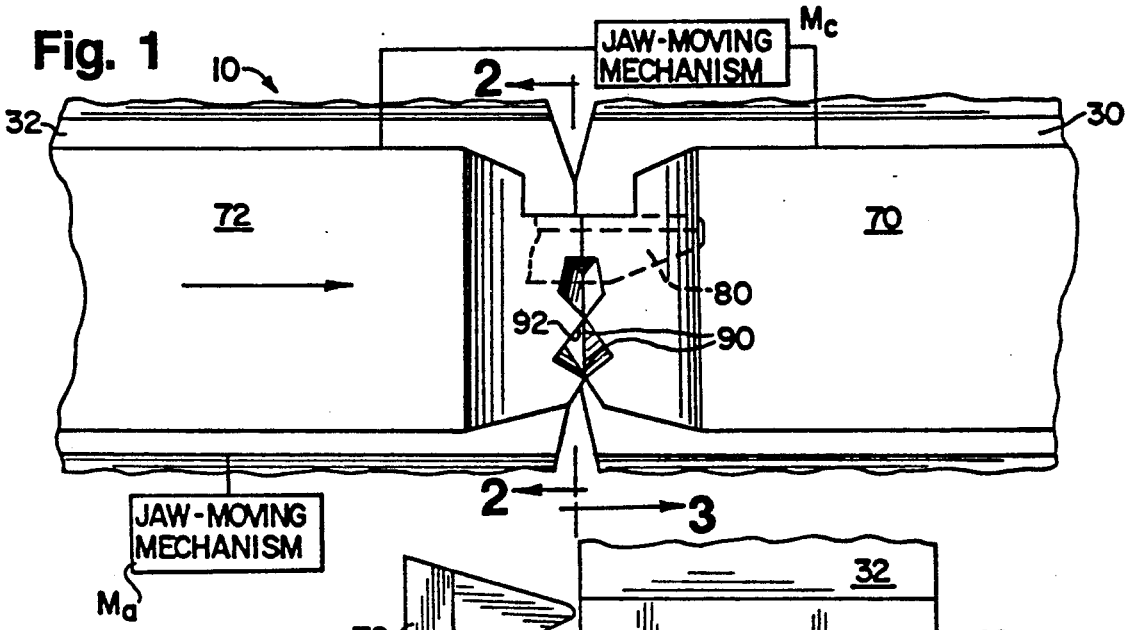
Fig. 2
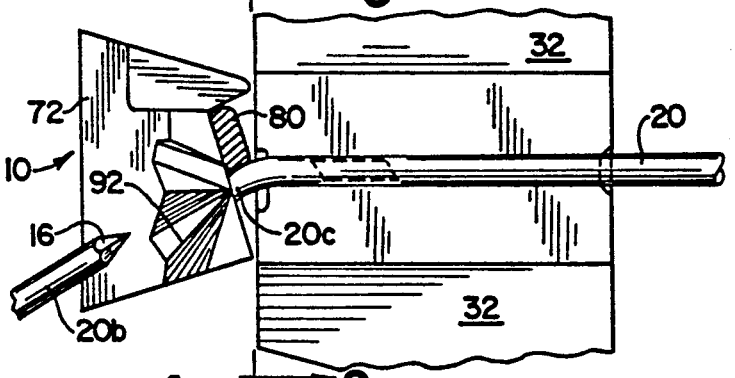
Fig. 3
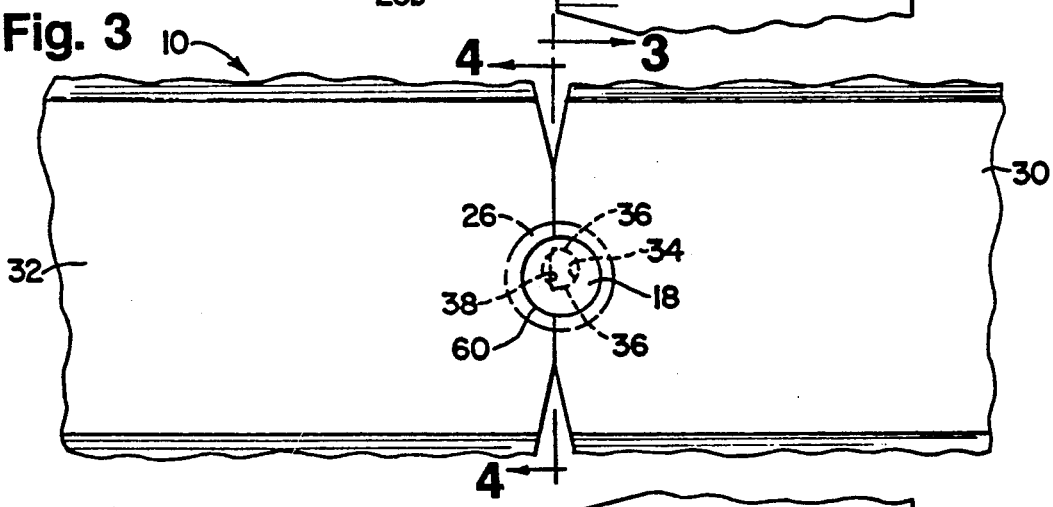
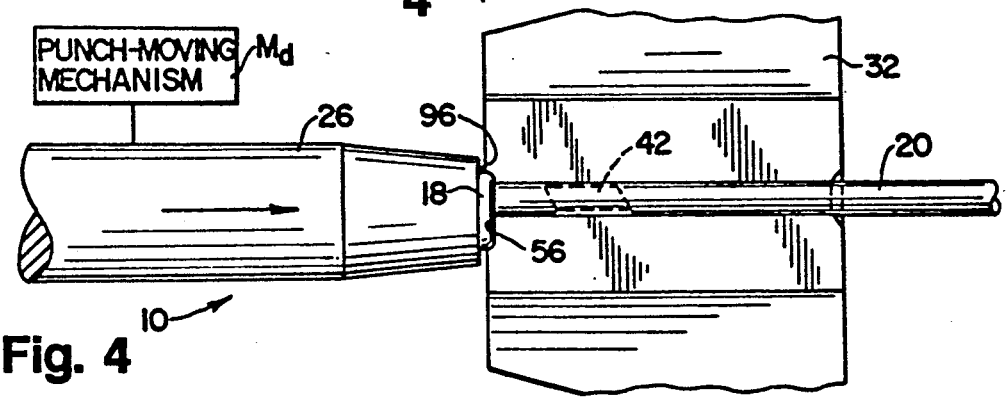
Fig. 4

Fig. 9
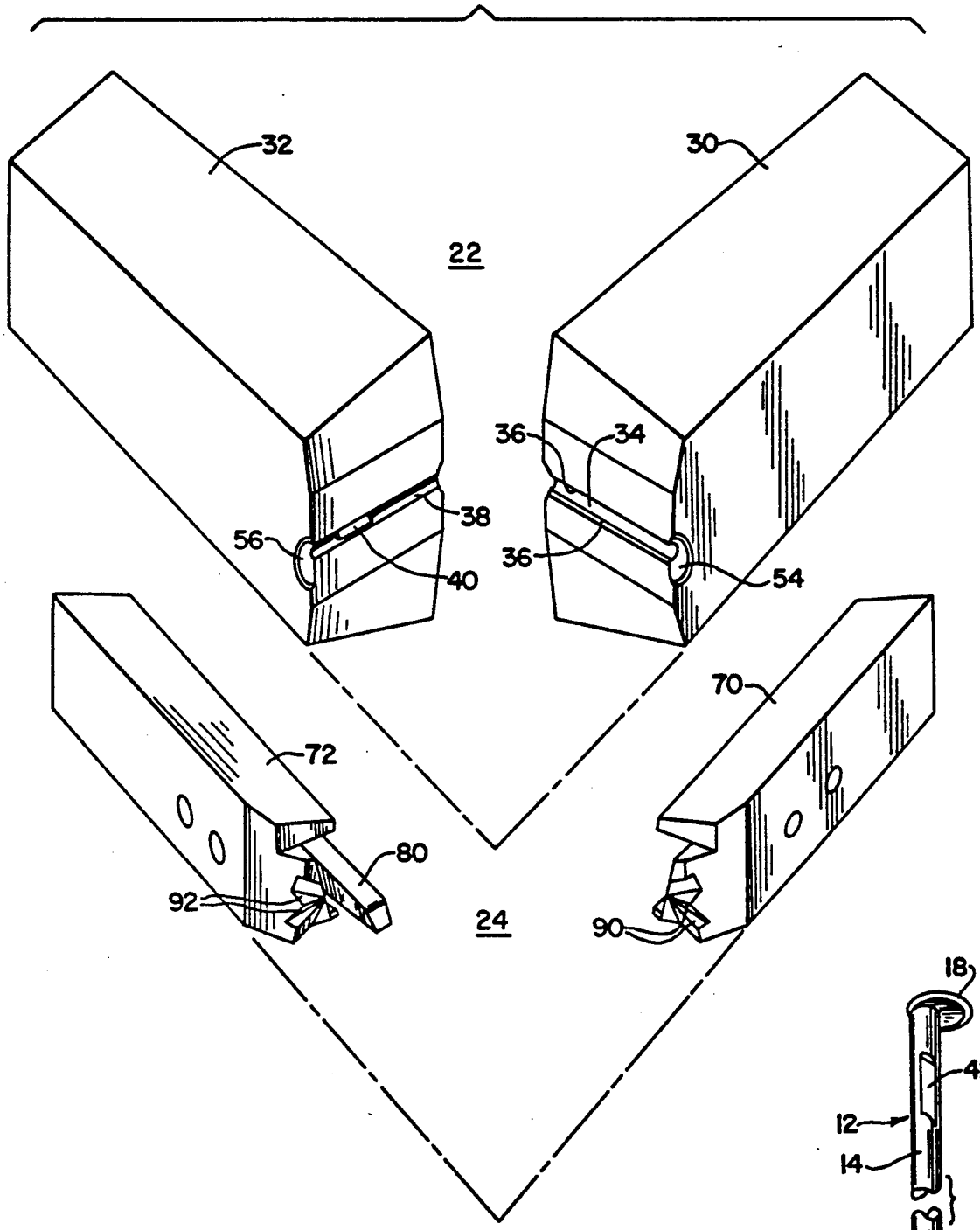
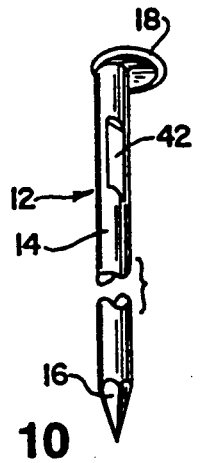
Fig. 10

METHOD AND APPARATUS FOR MAKING WIRE NAILS HAVING RADIALLY OFFSET, FULLY CIRCULAR HEADS

TECHNICAL FIELD OF THE INVENTION

This invention pertains to a method and apparatus for making nails having elongate shanks and radially offset, fully circular heads from a malleable wire, such as a carbon steel wire. The head of such a nail has a circumferential edge defining a axis in parallel but radially offset relation to an axis defined by the nail shank and conforming to a full circle when viewed axially.

BACKGROUND OF THE INVENTION

Typically, as used in pneumatically powered or combustion-powered nail-driving tools, wire nails having D-shaped or other heads that are not fully circular are collated by adhesively applied tapes or other collating media to form a strip. The shanks of the collated nails are oriented in closely spaced, parallel relation to one another and, except at one end of the strip, the head of one nail overlies the head of another nail.

For reasons of performance and aesthetics, it would be highly desireable to use wire nails having radially offset, fully circular heads in such a strip. It has proved to be very difficult to develop an efficient, commercially practicable way to make such nails, particularly in large production runs.

Wire nails having radially offset, fully circular heads, collated in a strip, are disclosed in O'Connor U.S. Pat. No. 3,358,822. The O'Connor patent does not disclose how to make such nails.

Wire nails having radially offset, fully circular heads, collated in a strip, and an apparatus for making such nails are disclosed in a copending application assigned commonly herewith, U.S. Ser. No. 07/597,025 filed Oct. 15, 1990, by Henry A. Sygnator for WIRE NAIL, STRIP OF COLLATED WIRE NAILS, AND RELATED APPARATUS. The apparatus disclosed therein must be precisely adjusted and may not be entirely satisfactory for making such nails in large production runs wherein precise adjustments of such an apparatus may be difficult to maintain.

This invention has resulted from further efforts to develop an efficient, commercially practicable way to make wire nails having radially offset, fully circular heads in large production runs.

SUMMARY OF THE INVENTION

This invention provides a novel method for making nails having elongate shanks and integral heads from a malleable wire, such as a carbon steel wire. Optimally, the novel method is practiced so that each nail has an elongate shank and a radially offset, fully circular head. The novel method is suitable for making such nails in large production runs.

Several operations are involved in the novel method. The wire is clamped with a clamping mechanism defining a clamping axis so that a length of the wire extends axially from the clamping mechanism. The extending length of the clamped wire is bent at an acute angle relative to the clamping axis, e.g. at about 20° relative thereto. A leading portion is cut from the bent length of the clamped wire so as to leave a bent stub extending from the clamping mechanism at a similar angle. A pointed end may be then formed on the leading portion as and where the leading portion is cut. A nail head is formed from the bent stub of the clamped wire. After the nail head has been formed, the wire is released from the clamping mechanism and is fed axially until a length of the wire extends axially from the clamping mechanism. These operations are repeated to form the shank and head of a nail from the leading portion cut in each repetition.

In a preferred mode for carrying out these operations, the wire is clamped with a clamping mechanism that defines a head-forming cavity when the wire is clamped. Thus, when the head is formed, the stub is pressed into the cavity and is deformed when pressed thereinto. Optimally, the cavity has a margin defining an axis parallel to but offset radially from the clamping axis and conforming to a full circle when viewed axially, and the bent stub extends generally toward the axis defined by the cavity before the nail head is formed. The bent stub has a volume sufficient to form a head when such stub is compressed in the cavity.

Preferably, the bent stub is engaged with a punch having a face extending at least as far as the margin of the cavity in all radial directions from the axis defined by the cavity. The punch face is moved, preferably in a direction parallel to the parallel axes, to press the stub into the cavity and to deform the stub as the stub is pressed thereinto.

A keyway may be also formed along the wire where the wire is clamped by the clamping mechanism. The keyway prevents relative rotation between the wire and the clamping mechanism and performs other important functions.

This invention provides a novel apparatus with components for carrying out various operations of the novel method. These components may replace known components in a nail-making machine of a commercially available type.

In the novel apparatus, a clamping mechanism is used. The clamping mechanism may include clamping jaws arranged to be relatively moveable between a closed configuration and an opened configuration. The clamping jaws are arranged to clamp the wire in the closed configuration and to release the wire in the opened configuration. In the closed configuration, the clamping jaws define a head-forming cavity, which has a margin conforming to a full circle. The cavity defines an axis parallel to but offset radially from the clamping axis.

The novel apparatus may comprise a punch having a face extending at least as far as the cavity margin in all radial directions from the cavity axis. The punch is moveable, preferably in a direction parallel to the parallel axes, to press the stub into the cavity with the punch face and to deform the stub as the stub is pressed thereinto.

Preferably, in the novel apparatus, cutting jaws are arranged to be relatively moveable between an opened configuration and a closed configuration. Preferably, moreover, a bending finger extends from one of the cutting jaws for bending the extended length of the wire as the cutting jaws are closed partly. The cutting jaws coact to cut the bent length of the wire as the cutting jaws are closed fully. The cutting jaws may be also arranged for forming a pointed end on the leading portion of the wire as and where the leading portion is cut from the bent length of the clamped wire.

BRIEF DESCRIPTION OF THE DRAWINGS

These and other objects, features, and advantages of this invention are evident from the following description of a preferred mode for carrying out the novel method and of a preferred embodiment of the novel apparatus with reference to the accompanying drawings, in which like reference characters designate like or corresponding parts throughout the several views, and wherein:

FIG. 1 is a fragmentary, elevational view showing two relatively moveable clamping jaws in a closed configuration in the background, namely a fixed cutting jaw on the right and a moveable cutting jaw on the left, and two relatively moveable cutting jaws in the foreground. The cutting jaw on the left includes a bending finger.

FIG. 2 is a fragmentary, sectional view taken along line 2—2 in FIG. 1, in a direction indicated by arrows, after a malleable wire clamped by the clamping jaws has been bent at an acute angle by the bending finger. A leading portion of the wire is shown as having been cut from the clamped wire by the cutting jaws so as to leave a bent stub extending from the clamping jaws at such an angle.

FIG. 3 is a fragmentary, sectional view taken along line 3—3 in FIG. 2, in a direction indicated by arrows, after the bent stub has been pressed into a head-forming cavity defined by the clamping jaws, by a punch shown in phantom outline, so as to form a radially offset, fully circular head.

FIG. 4 is a view similar to FIG. 2, except that the bent stub has been pressed into the headforming cavity by the punch. The cutting jaw shown in FIG. 2 is not shown in FIG. 4.

FIG. 9 is an exploded, perspective view of the clamping and cutting jaws.

FIG. 10 is a perspective view of an exemplary nail having an elongate shank with a pointed end, and with a keyway, and having a radially offset, fully circular head.

DETAILED DESCRIPTION OF PREFERRED APPARATUS

Figure 5:
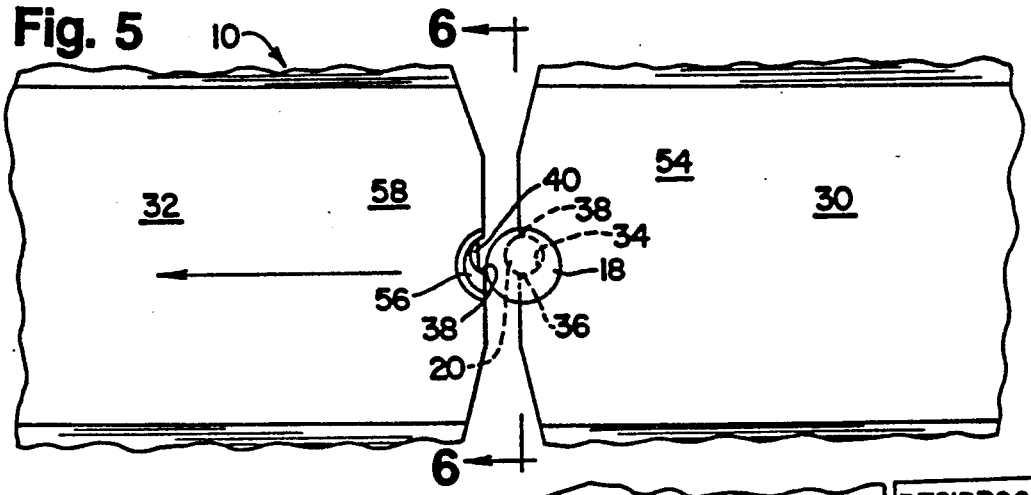
FIG. 5 is a view similar to FIG. 3, except that the moveable clamping jaw has been moved away from the fixed clamping jaw so as to permit the wire to be axially fed.

As shown in FIGS. 1 through 9, an apparatus 10 is preferred for carrying out the novel method provided by this invention for making nails 12 having elongate shanks 14 with conventional, four-faceted, pointed ends 16 and having radially offset, circular heads 18 from a malleable, carbon steel wire 20 of a given, uniform diameter and of an indeterminate length. An exemplary nail 12 formed by the novel method, in the apparatus 10, is shown in FIG. 10.

The apparatus 10 comprises a clamping mechanism 22 with novel features and a cutting mechanism 24 with novel features. The clamping mechanism 22 and the cutting mechanism 24 replace the clamping and cutting mechanisms provided heretofore in a nail-making machine of a known type, such as a Wafios Model N51 Nail-Making Machine, which is available commercially from Wafios Maschinenfabrik GmbH & Co. KG of Reutlingen, Germany. The apparatus 10 comprises a punch 26 similar to the punch provided heretofore in such a nail-making machine.

The clamping mechanism 22 comprises two relatively moveable clamping jaws, namely a clamping jaw 30 mounted fixedly in the nail-making machine and a clamping jaw 32 moveable transversely toward and away from the fixed jaw 30. In a closed configuration (see FIGS. 1, 3, and 7) wherein the clamping jaws 30, 32, are closed, the moveable jaw 32 is moved toward the fixed jaw 30 and engages the fixed jaw 30. In an opened configuration (see FIG. 5) wherein the clamping jaws 30, 32, are opened, the moveable jaw 32 is moved away from the fixed jaw 30.

The fixed jaw 30 has a longitudinal groove 34, which conforms to a major portion (about 210°) of a right circular cylinder, except that the groove 34 has flared upper and lower margins 36 (see FIG. 3) permitting the wire 20 to move transversely into and out from the groove 34 without binding. The moveable jaw 32 has a longitudinal groove 38, which conforms to a minor portion (about 150°) of the same cylinder. Such cylinder has a diameter approximating the diameter of the wire 20.

When the clamping jaws 30, 32, are closed, the clamping mechanism 22 defines a clamping axis and is arranged to clamp the wire 20 tightly within the longitudinal grooves 34, 38. It is not necessary for the clamping jaws 30, 32, to meet for the wire 20 to be tightly clamped. The nail-making machine incorporating the clamping mechanism 22 comprises a mechanism $M_a$ for causing relative movement of the clamping jaws 30, 32, between the opened and closed configurations.

Because the longitudinal grooves 34, 38, conform respectively to such major and minor portions of the same cylinder, the clamping jaws 30, 32, meet when closed at a plane spaced transversely (leftwardly in FIGS. 1, 3, and 7) from a diametrical plane bisecting the clamped wire 20 within the longitudinal grooves 34, 38. Thus, any flash (not shown) that may be formed on the wire 20 when the clamping jaws 30, 32, are closed is spaced from such a diametrical plane so as not to interfere materially with collating of the nails 12 formed from the wire 20. In an alternative embodiment (not shown) each of the longitudinal grooves 34, 38, may be semi-cylindrical, each conforming to one half (180°) of such a cylinder.

The longitudinal groove 38 of the moveable jaw 32 has a nub 40 integral with the moveable jaw 32. The nub 40 is shaped to form a keyway 42 (see FIG. 10) along a portion of the wire 20 to become the shank 14 of the nail 12 being made, by deforming some of the malleable wire 20, as the moveable jaw 32 is moved toward the fixed jaw 30. The copending application noted above discloses a similar keyway being formed in a wire portion to become a nail shank. The keyway 42 prevents relative rotation between the wire 20 and the clamping jaws 30, 32, as each nail 12 is made. Other important functions of such keyways in collating wire nails are disclosed in a related application assigned commonly herewith, U.S. Ser. No. 07/597,022 filed Oct. 15, 1990, by Robert W. Wright et al. for MACHINE AND METHOD FOR COLLATING WIRE NAILS HAVING SHANK KEYWAYS, now U.S. Pat. No. 5,058,228.

Figure 6:
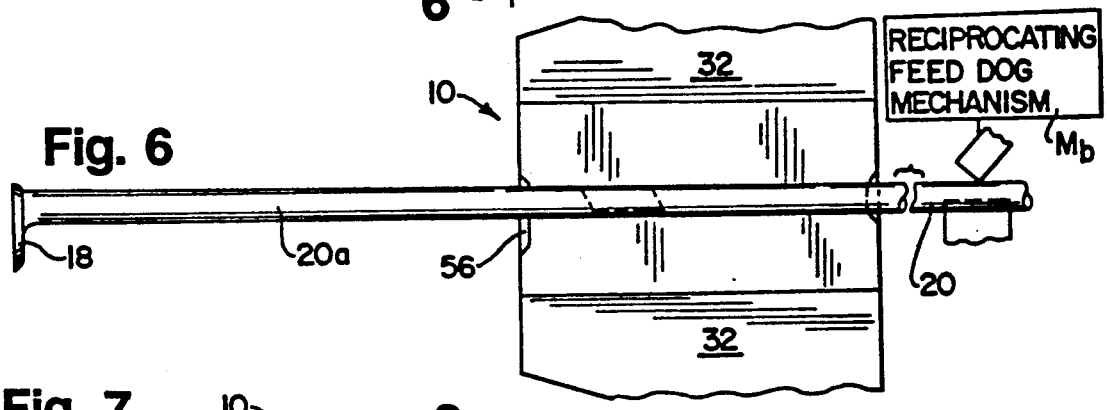
FIG. 6 is a fragmentary, sectional view taken along line 6—6 in FIG. 5, in a direction indicated by arrows. A means for feeding the wire axially is represented by a reciprocating feed dog mechanism.

The nail-making machine incorporating the apparatus 10 has a reciprocating feed dog mechanism $M_b$ of known construction, as shown diagrammatically in FIG. 6, for feeding the wire 20 axially during the nail-making process. The mechanism $M_b$ has moved the wire 20 a predetermined length from the clamping jaws 30, 32, which is commensurate with the desired length of the nail to be formed.

When the clamping jaws 30, 32, are closed the clamping mechanism 22 defines a head-forming cavity 50. The cavity 50 is defined by a partial cavity 52 at a front face 54 of the fixed jaw 30 and by a partial cavity 56 at a front face 58 of the moveable jaw 32. The front faces 54, 58, are coplanar. The cavity 50 has a margin 60 defining an axis parallel to but offset radially from the clamping axis and conforming to a full circle when viewed axially. As shown in FIGS. 2, 4, 6, and 8, the margin 60 is frusto-conical and tapers inwardly from the front faces 54, 58.

The cutting mechanism 24 comprises two relatively moveable cutting jaws 70, 72, which are moveable transversely between a closed configuration and an opened configuration. In the closed configuration, the cutting jaws 70, 72, are closed, as shown in FIG. 1. In the opened configuration, the cutting jaws 70, 72, are opened so as to permit the wire 20 to be axially fed therebetween. The nail-making machine incorporating the apparatus 10 has a mechanism $M_c$ for moving the cutting jaws 70, 72, between the opened and closed configurations.

Figure 7:
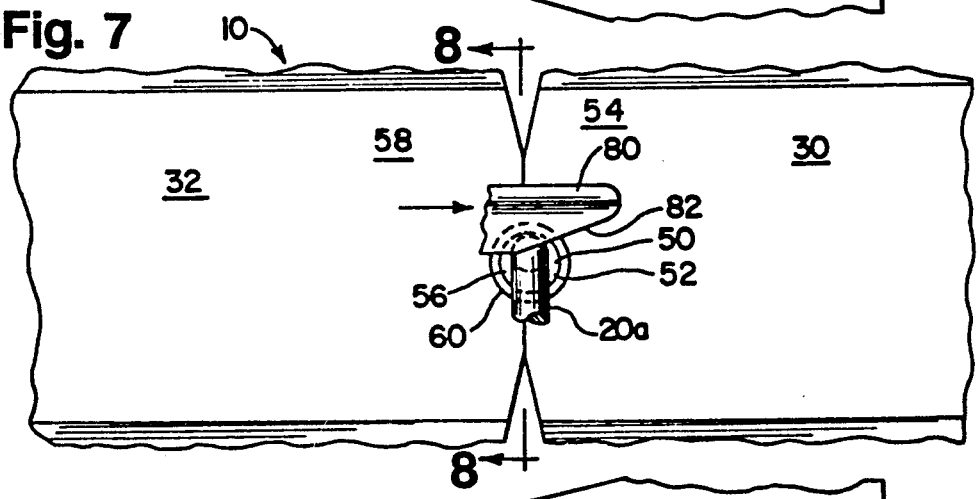
FIG. 7 is a view similar to FIG. 3, except that the leading portion of the clamped wire is shown as having been bent downwardly by a bending finger on one of the cutting jaws, before the bent portion is cut from the clamped wire by the cutting jaws.
Figure 8:
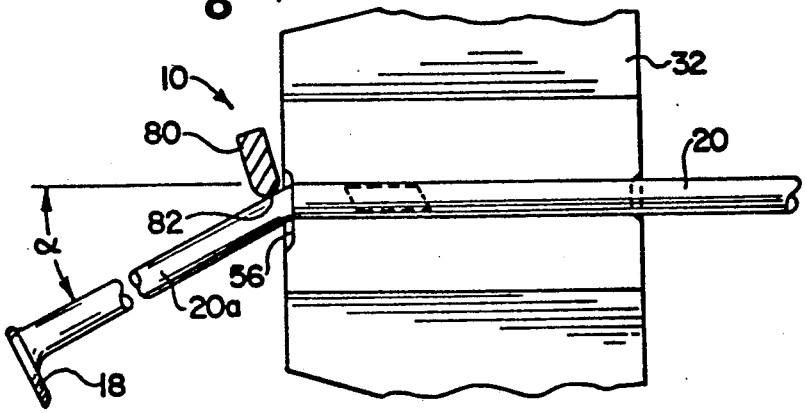
FIG. 8 is a fragmentary, sectional view taken along line 8—8 in FIG. 7, in a direction indicated by arrows. The leading portion of the clamped wire is shown as having a nail head formed thereon.

As shown in FIGS. 7 and 8, the cutting jaw 72 has a bending finger 80 having a lower, camming surface 82. The lower, camming surface 82 faces downwardly, toward the cutting jaw 70, and at an acute angle relative to a horizontal plane and faces downwardly, backwardly, and at an acute angle relative to a vertical plane.

Thus, as shown in FIGS. 7 and 8, if a predetermined length **20*a* of the clamped wire 20 extends axially (along the clamping axis) from the clamping mechanism 22 when the cutting jaws 70, 72, move toward the closed configuration, the bending finger 80 engages the extending length 20*a* at the camming surface 82. The bending finger 80 bends the extending length 20*a* downwardly at an acute angle (about 20°) relative to the clamping axis as the cutting jaws 70, 72**, are closed partly.

The cutting jaw 70 has tapered cutting edges 90. The cutting jaw 72 has tapered cutting edges 92. The cutting edges 90, 92, are complementary and are adapted to cut a leading portion **20*b* from the bent length 20*a*, to form a conventional, four-faceted, pointed end 16 on the bent length 20*a*, and to leave a bent stub 20*c* of a predetermined length extending from the clamping mechanism 22 as the cutting jaws 70, 72, are closed fully. The cutting edges 90, 92, are similar to tapered cutting edges of known cutting jaws, such as the cutting jaws replaced by the cutting jaws 70, 72, except that the cutting edges 90, 92, are oriented so as to cut the wire 20 with the wire 20** extending at the acute angle noted above (about 20°) relative to the clamping axis, rather than axially.

The cutters 70, 72, are moveable transversely in a region spaced by a predetermined distance from the clamping mechanism 22 so that the bent stub **20*c* has a volume equal approximately to the volume of the head-forming cavity 50. Optimally, the bent stub 20*c* has a volume sufficient to form a nail head. When the cutting jaws 70, 72, are opened, the bent stub 20*c* tends to rebound slightly so as to extend downwardly from the clamping mechanism 22 at a slightly smaller angle (about 18°) relative to the clamping axis, because of inherent resiliency of the wire 20**.

The punch 26, which is made from tool steel, is moveable along the axis defined by the cavity 60, toward and away from the front faces 54, 58, of the clamping jaws 30, 32. The punch 26 has a flat face 96 extending beyond the margin 60 in all radial directions from the same axis. The nail-making machine incorporating the apparatus 10 has a mechanism $M_d$ for moving the punch 26 along the same axis, toward and away from the jaw faces 54, 58, as the mechanism $M_d$ would be ordinarily used to move a punch in the nail-making machine.

Initially, in each operating cycle of the nail-making machine incorporating the apparatus 10, the clamping jaws 30, 32, are closed with the wire 20 within the longitudinal grooves 34, 38, so that the predetermined length **20*a* of the wire 20 extends axially from the clamping mechanism 22. Thereupon, the cutting jaws 70, 72, are closed partly so that the extending length $20_a$ of the clamped wire 20 is bent by the bending finger 80 at an acute angle (about 20°) relative to the clamping axis defined by the clamping mechanism 22**.

While the wire 20 remains clamped, the cutting jaws 70, 72, are closed fully so that the leading portion **20*b* is cut from the bent length 20*a*, and so that a bent stub 20*c* extending from the clamping mechanism 22 is left. A four-faceted, pointed end 16 is formed on the leading portion 20*b* as and where the leading portion 20*b*** is cut therefrom.

Next, the punch 26 is moved so as to press the bent stub **20*c* of the clamped wire 20 into the head-forming cavity 50 with the punch face 96, and so as to deform the stub 20*c* as the stub 20*c* is pressed thereinto. Thus, the stub 20*c* is deformed so as to fill the cavity 50, and so as to form a radially offset, circular nail head 18 on the clamped wire 20**.

These operations of the apparatus 10 are repeated cyclicly to make a succession of similar nails 12 from the wire 20.

Various modifications may be made in the preferred embodiment described above without departing from the scope and spirit of this invention which is defined by means of the appended claims. It is therefore to be understood that within the scope of the appended claims, the present invention may be practiced otherwise than as specifically described herein.

We claim:

1. A method for manufacturing nails having elongate shanks and integral heads from a malleable wire, comprising the steps of:

(a) clamping the wire with a clamping mechanism defining a clamping axis so that a length of the wire extends axially from the clamping mechanism;

(b) bending the extending length of the clamped wire at an acute angle relative to the clamping axis;

(c) cutting a leading portion of said bent extending length of said clamped wire from the entire bent extending length portion of the clamped wire from the entire bent extending length portion clamping mechanism;

(d) forming a nail head from the bent stub of the clamped wire whereby said nail head is offset with respect to said clamping axis;

(e) releasing the wire from the clamping mechanism after the head forming step;

(f) feeding the released wire axially until a length of the wire extends axially from the clamping mechanism; and (g) repeating steps (a) through (F) so as to repetitively form the shank and head of a nail from the leading portion of said clamped wire cut within each repetition cycle except possibly for an initial cycle of steps.

2. The method of claim 1 wherein the cutting step comprises forming a pointed end on the leading portion as and where the leading portion is cut from the bent length of the clamped wire.

3. The method of claim 1 wherein the clamping step comprises clamping the wire with a clamping mechanism defining a head-forming cavity when the wire is clamped therewithin and wherein the forming step comprises pressing the stub into the cavity and deforming the stub as the stub is pressed thereinto so as to form said head.

4. The method of claim 1 wherein the clamping step comprises clamping the wire with a clamping mechanism defining a head-forming cavity when the wire is clamped therewith, the cavity having a margin conforming to a full circle and defining an axis parallel to but offset radially from the clamping axis, and wherein the bending and cutting steps are performed in such manner that the bent stub extends generally toward the axis defined by the cavity before the nail head is formed.

5. The method of claim 4 wherein the forming step comprises engaging the bent stub with a punch having a face extending at least as far as the margin of the head-forming cavity in all radial directions from the axis defined by the cavity and comprises moving the punch face toward the clamping mechanism to press the stub into the cavity with the punch face and to deform the stub as the stub is pressed thereinto.

6. The method of claim 4 wherein the forming step comprises engaging the bent stub with a punch having a face extending at least as far as the margin of the head-forming cavity in all radial directions from the axis defined by the cavity and comprises moving the punch face toward the clamping mechanism, in a direction parallel to the parallel axes, to press the stub into the cavity with the punch face and to deform the stub as the stub is pressed thereinto.

7. The method of claim 6 wherein the cutting step comprises cutting a leading portion from the bent length of the clamped wire so as to leave a bent stub extending from the clamping mechanism with a sufficient volume to form a nail head, whereby the nail head formed therefrom tends to be fully circular when viewed endwise.

8. The method of claim 1 wherein the clamping step comprises forming a keyway along the wire where the wire is clamped by the clamping mechanism.

9. The method of claim 1 wherein the clamping step comprises forming a keyway along the wire where the wire is clamped by the clamping mechanism in each repetition so that the leading portion cut in each repetition is formed with such a keyway.

10. A method for manufacturing nails having elongate shanks and integral heads from a malleable wire, comprising the steps of:

(a) clamping the wire with a clamping mechanism defining a clamping axis so that a length of the wire extends axially therefrom;

(b) bending the extending length of the clamped wire at an acute angle relative to the clamping axis;

(c) cutting a leading portion of said bent length of said clamped wire from the entire bent length portion of the clamped wire and forming a pointed end upon the leading portion of the bent length of said clamped wire as and wherein the leading portion of the bent length of said clamped wire is cut so as to leave a bent stub extending from the clamping mechanism;

(d) forming a nail head from the bent stub of the clamped wire so that the nail head tends to be fully circular when viewed endwise and wherein said nail head is offset with respect to said clamping axis;

(e) releasing the wire from the clamping mechanism after the head forming step;

(f) feeding the released wire axially until a length of the wire extends axially from the clamping mechanism; and (g) repeating steps (a) through (f) so as to form the shank and head of a nail from the leading portion of said clamped wire cut within each repetition cycle except possibly for an initial cycle of steps.

11. A method for manufacturing nails having elongate shanks and integral heads from a malleable wire, comprising the steps of:

(a) clamping the wire with a clamping mechanism defining a clamping axis so that a length of the wire extends axially therefrom, the extending length of said wire having a nail head formed thereon;

(b) bending the extending length of the clamped wire at an acute angle relative to the clamping axis;

(c) cutting a leading portion of said bent length of said clamped wire from the entire bent length of the clamped wire, and forming a pointed end upon the leading portion of the bent length of said clamped wire as and where the leading portion of the bent length of said clamped wire is cut from said entire bent length of said clamped wire, so as to leave a bent stub extending from the clamping mechanism;

(d) forming a nail head from the bent stub of the clamped wire whereby said nail head is offset with respect to said clamping axis; j (e) releasing the wire from the clamping mechanism after the head forming step;

(f) feeding the released wire axially until a length of the wire extends axially from the clamping mechanism; and (g) repeating steps (a) through (f) so as to form the shank and head of a nail from the leading portion of said clamped wire cut within each repetition cycle.

12. Apparatus of manufacturing nails having elongate shanks and radially offset, fully circular heads from a malleable wire, comprising:

(a) means, including a clamping mechanism defining a clamping axis, for clamping the wire so that a leading portion of the wire extends axially outwardly from the clamping mechanism, and for releasing the wire from the clamping mechanism so as to permit the wire to be fed axially;

(b) means for bending the leading portion of said wire extending axially outwardly from the clamping mechanism at an acute angle relative to the clamping axis;

(c) means for cutting the bent leading portion of the clamped wire so as to leave a bent stub extending outwardly from the clamping mechanism;

(d) means for forming a nail head from the bent stub of the clamped wire; and (e) means for axially feeding the wire disposed within the clamping mechanism when released by said clamping mechanism until a new leading portion of the wire extends axially outwardly from the clamping mechanism, the apparatus being operable repetitively so that the apparatus forms the shank and head of an ail from the leading portion of the clamped wire cut within each repetition cycle except possibly for an initial operation cycle.

13. The apparatus of claim 12 wherein the cutting means includes means for forming a pointed end on the leading portion as and where the leading portion is cut from the bent length of the clamped wire.

14. The apparatus of claim 12 wherein the clamping mechanism includes clamping jaws arranged to be relatively moveable between a closed configuration and an opened configuration, to clamp the wire in the closed configuration, and to release the wire in the opened configuration, the jaws defining a head-forming cavity in the closed configuration, the cavity having a margin defining an axis parallel to but offset radially from the clamping axis and conforming to a full circle when viewed axially.

15. The apparatus of claim 14 wherein the forming means comprises a punch having a face extending at least as far as the margin of the head-forming cavity in all radial directions from the axis defined by the head-forming cavity, the punch being moveable to press the stub into the cavity with the punch face, and to deform the stub as the stub is pressed thereinto so as to form said head.

16. The apparatus of claim 15 wherein the punch is moveable in a direction parallel to the parallel axes.

17. The apparatus of claim 14 wherein the clamping jaws include means for forming a keyway along the wire where the wire is clamped.

18. The apparatus of claim 14 wherein one of the clamping jaws has the means for forming a keyway along the wire.

19. The apparatus of claim 12 wherein the bending and cutting means comprise cutting jaws arranged to be relatively moveable between an opened configuration and a closed configuration and a bending finger extending from one of the cutting jaws and constituting means for bending the extending length of the wire as the cutting jaws are moved from the opened configuration toward the closed configuration, the cutting jaws coacting to cut the bent length of the wire as the cutting jaws are moved into the closed configuration.

20. The apparatus of claim 19 wherein the cutting jaws include means for forming a pointed end on the leading portion of the wire as and where the leading portion is cut form the bent length of the clamped wire.

* * * * *